US010378090B2

(12) United States Patent
Kawano et al.

(10) Patent No.: US 10,378,090 B2
(45) Date of Patent: Aug. 13, 2019

(54) STEEL MATERIAL

(71) Applicant: NIPPON STEEL & SUMITOMO METAL CORPORATION, Tokyo (JP)

(72) Inventors: Kaori Kawano, Tokyo (JP); Masahito Tasaka, Tokyo (JP); Yoshiaki Nakazawa, Tokyo (JP); Yasuaki Tanaka, Tokyo (JP); Toshiro Tomida, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 14/391,417

(22) PCT Filed: Jul. 22, 2013

(86) PCT No.: PCT/JP2013/069805
§ 371 (c)(1),
(2) Date: Oct. 9, 2014

(87) PCT Pub. No.: WO2014/014120
PCT Pub. Date: Jan. 23, 2014

(65) Prior Publication Data

US 2015/0071812 A1 Mar. 12, 2015

(30) Foreign Application Priority Data

Jul. 20, 2012 (JP) ..... 2012-161730

(51) Int. Cl.
*C22C 38/00* (2006.01)
*C22C 38/02* (2006.01)
(Continued)

(52) U.S. Cl.
CPC ..... *C22C 38/38* (2013.01); *C21D 8/0226* (2013.01); *C21D 8/0236* (2013.01);
(Continued)

(58) Field of Classification Search
CPC ..... C22C 38/00; C22C 38/001; C22C 38/02; C22C 38/04; C22C 38/05
See application file for complete search history.

(56) References Cited

U.S. PATENT DOCUMENTS 7,534,312 B2 5/2009 Yoshinaga et al.
2002/0179193 A1* 12/2002 Yokoi ..... C21D 8/0226 148/332
(Continued)

FOREIGN PATENT DOCUMENTS

CN 101724776 A 6/2010
CN 101910438 A 12/2010
(Continued)

OTHER PUBLICATIONS

S. C. Hong, K. S. Lee. "Influence of deformation induced ferrite transformation on grain refinement of dual phase steel." Materials Science and Engineering A323 (2002) 148-159.*
(Continued)

*Primary Examiner* — Paul A Wartalowicz
*Assistant Examiner* — Stephani Hill
(74) *Attorney, Agent, or Firm* — Birch, Stewart, Kolasch & Birch, LLP

(57) ABSTRACT

A steel material comprising, by mass%, C: greater than 0.05% to 0.2%, Mn: 1% to 3%, Si: greater than 0.5% to 1.8%, Al: 0.01% to 0.5%, N: 0.001% to 0.015%, Ti or a sum of V and Ti: greater than 0.1% to 0.25%, Ti: 0.001% or more, Cr: 0% to 0.25%, Mo: 0% to 0.35%, the balance: Fe and impurities, comprising a multi-phase structure having a ferrite main phase and a second phase containing one or more of bainite, martensite and austenite, wherein an average nanohardness of the second phase is less than 6.0 GPa, an average grain diameter of all crystal grains in the main phase and the second phase is 3 μm or less, and a proportion of a length of small-angle grain boundaries where the
(Continued)

misorientation is 2° to less than 15° in a length of all grain boundaries is 15% or more.

3 Claims, 2 Drawing Sheets

(51) Int. Cl.

| | |
|---|---|
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/22*** | (2006.01) |
| ***C22C 38/24*** | (2006.01) |
| ***C22C 38/28*** | (2006.01) |
| ***C22C 38/34*** | (2006.01) |
| ***C22C 38/38*** | (2006.01) |
| ***C21D 8/02*** | (2006.01) |
| *C21D 1/32* | (2006.01) |

(52) U.S. Cl.

CPC ..... *C21D 8/0273* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C22C 38/22* (2013.01); *C22C 38/24* (2013.01); *C22C 38/28* (2013.01); *C22C 38/34* (2013.01); *C21D 1/32* (2013.01); *C21D 2211/001* (2013.01); *C21D 2211/002* (2013.01); *C21D 2211/004* (2013.01); *C21D 2211/005* (2013.01); *C21D 2211/008* (2013.01); *C22C 2202/00* (2013.01)

(56) References Cited

U.S. PATENT DOCUMENTS

| | | | |
|---|---|---|---|
| 2008/0131305 | A1 | 6/2008 | Okitsu |
| 2010/0108200 | A1 | 5/2010 | Futamura et al. |

FOREIGN PATENT DOCUMENTS

| | | | | | |
|---|---|---|---|---|---|
| JP | 11-80879 | A | | 3/1999 | |
| JP | 11-269606 | A | | 10/1999 | |
| JP | 2000-17385 | A | | 1/2000 | |
| JP | 2004-84074 | A | | 3/2004 | |
| JP | 2004-277858 | A | | 10/2004 | |
| JP | 2005307246 | A | * | 11/2005 | ..... C22C 38/00 |
| JP | 2006-161077 | A | | 6/2006 | |
| JP | 2009-167467 | A | | 7/2009 | |
| JP | 2011-214073 | A | | 10/2011 | |
| JP | 2012-1773 | A | | 1/2012 | |
| JP | 2012-7649 | A | | 1/2012 | |
| KR | 10-2010-0048916 | A | | 5/2010 | |
| TW | I290177 | B | | 11/2007 | |
| WO | WO 2009082091 | A1 | * | 7/2009 | ..... C21D 8/0426 |

OTHER PUBLICATIONS

"Effects of alloying elements." Classification and Designation of Carbon and Low-Alloy Steels, Properties and Selection: Irons, Steels, and High-Performance Alloys, vol. 1, ASM Handbook, ASM International, 1990, 140-194.*

G. F. Vander Voort. "Temper embrittlement in alloy steels" Embrittlement of Steels, Properties and Selection: Irons, Steels, and High-Performance Alloys, vol. 1 1, ASM Handbook ASM International, 1990, 689-699.*

JP2005307246 machine translation.*

JP2012-001773 machine translation.*

"Nano- versus micro-indentation hardness." Nanomechanics, Inc. http://nanomechanicsinc.com/indentation-hardness/. Accessed Jan. 13, 2017.*

B. L. Bramfitt. Effect of Composition, Processing, and Structure on Properties of Irons and Steels. Materials Selection and Design. vol. 20. ASM Handbook. ASM International. 1997, p. 357-382.*

"Toughness." NDT Resource Center. https://www.nde-ed.org/EducationResources/CommunityCollege/Materials/Mechanical/Toughness.htm. Accessed Jan. 14, 2017.*

JP 2005-307246 machine translation and written English translation of Table 2 headings.*

JP 2012-007649 machine translation.*

Krauss. Martensite in steel: strength and structure. Materials Science and Engineering A273-275 (1999) 40-57. (Year: 1999).*

International Search Report issued in PCT/JP2013/069805, dated Oct. 8, 2013.

PCT/ISA/237—Issued in PCT/JP2013/069805, dated Oct. 8, 2013.

Korean Office Action, dated Jun. 14, 2016, for corresponding Korean Application No. 10-2014-7036128, along with a partial English translation.

Chinese Office Action and Search Report issued in corresponding Chinese Application No. 201380037672.3, dated Mar. 29, 2017, together with a partial English translation of the Chinese Office Action.

Korean Notice of Final Rejection issued in corresponding Korean Application No. 10-2014-7036128, dated Mar. 24, 2017, together with a partial English translation.

Indian Examination Report issued in corresponding Indian Application No. 8577/DELNP/2014, dated Dec. 26, 2018, together with an English translation.

Brazilian Office Action issued in corresponding Brazilian Application No. 112015000845-3, dated Apr. 9, 2019, together with a partial English translation.

* cited by examiner

STEEL MATERIAL

TECHNICAL FIELD

The present invention relates to a steel material, and concretely relates to a steel material suitable for a material of an impact absorbing member in which an occurrence of crack when applying an impact load is suppressed, and further, an effective flow stress is high. This application is based upon and claims the benefit of priority of the prior Japanese Patent Application No. 2012-161730, filed on Jul. 20, 2012, the entire contents of which are incorporated herein by reference.

BACKGROUND ART

In recent years, from a point of view of global environmental protection, a reduction in weight of a vehicle body of automobile has been required as a part of reduction in $CO_2$ emissions from automobiles, and a high-strengthening of a steel material for automobile has been aimed. This is because, by improving the strength of steel material, it becomes possible to reduce a thickness of the steel material for automobile. Meanwhile, a social need with respect to an improvement of collision safety of automobile has been further increased, and not only the high-strengthening of steel material but also a development of steel material excellent in impact resistance when a collision occurs during traveling, has been desired.

Here, respective portions of a steel material for automobile at a time of collision are deformed at a high strain rate of several tens ($s^{-1}$) or more, so that a high-strength steel material excellent in dynamic strength property is required.

As such a high-strength steel material, a low-alloy TRIP steel having a large static-dynamic difference (difference between static strength and dynamic strength), and a high-strength multi-phase structure steel material such as a multi-phase structure steel having a second phase mainly formed of martensite, are known.

Regarding the low-alloy TRIP steel, for example, Patent Document 1 discloses a strain-induced transformation type high-strength steel sheet (TRIP steel sheet) for absorbing collision energy of automobile excellent in dynamic deformation property.

Further, regarding the multi-phase structure steel sheet having the second phase mainly formed of martensite, inventions as will be described below are disclosed.

Patent Document 2 discloses a high-strength steel sheet having an excellent balance of strength and ductility and having a static-dynamic difference of 170 MPa or more, the high-strength steel sheet being formed of fine ferrite grains, in which an average grain diameter ds of nanocrystal grains each having a crystal grain diameter of 1.2 μm or less and an average crystal grain diameter dL of microcrystal grains each having a crystal grain diameter of greater than 1.2 μm satisfy a relation of $dL/ds \geq 3$.

Patent Document 3 discloses a steel sheet formed of a dual-phase structure of martensite whose average grain diameter is 3 μm or less and martensite whose average grain diameter is 5 μm or less, and having a high static-dynamic ratio.

Patent Document 4 discloses a cold-rolled steel sheet excellent in impact absorption property containing 75% or more of ferrite phase in which an average grain diameter is 3.5 μm or less, and a balance composed of tempered martensite.

Patent Document 5 discloses a cold-rolled steel sheet in which a prestrain is applied to produce a dual-phase structure formed of ferrite and martensite, and a static-dynamic difference at a strain rate of $5\times10^2$ to $5\times10^3$/s satisfies 60 MPa or more.

Further, Patent Document 6 discloses a high-strength hot-rolled steel sheet excellent in impact resistance property formed only of hard phase such as bainite of 85% or more and martensite.

PRIOR ART DOCUMENT

Patent Document

Patent Document 1: Japanese Laid-open Patent Publication No. H11-80879

Patent Document 2: Japanese Laid-open Patent Publication No. 2006-161077

Patent Document 3: Japanese Laid-open Patent Publication No. 2004-84074

Patent Document 4: Japanese Laid-open Patent Publication No. 2004-277858

Patent Document 5: Japanese Laid-open Patent Publication No. 2000-17385 Patent Document 6: Japanese Laid-open Patent Publication No. H11-269606

DISCLOSURE OF THE INVENTION

Problems to be Solved by the Invention

However, the conventional steel materials being materials of impact absorbing members have the following problems. Specifically, in order to improve an impact absorption energy of an impact absorbing member (which is also simply referred to as "member", hereinafter), it is essential to increase a strength of a steel material being a material of the impact absorbing member (which is also simply referred to as "steel material", hereinafter).

However, as disclosed in "Journal of the Japan Society for Technology of Plasticity" vol. 46, No. 534, pages 641 to 645, that an average load ($F_{ave}$) determining an impact absorption energy is given in a manner that $F_{ave} \propto (\sigma Y \cdot t^2)/4$, in which σY indicates an effective flow stress, and t indicates a sheet thickness, the impact absorption energy greatly depends on the sheet thickness of steel material. Therefore, there is a limitation in realizing both of a reduction in thickness and a high impact absorbency of the impact absorbing member only by increasing the strength of the steel material.

Here, the flow stress corresponds to a stress required for successively causing a plastic deformation at a start or after the start of the plastic deformation, and the effective flow stress means a plastic flow stress which takes a sheet thickness and a shape of the steel material and a rate of strain applied to a member when an impact is applied into consideration.

Incidentally, for example, as disclosed in pamphlet of International Publication No. WO 2005/010396, pamphlet of International Publication No. WO 2005/010397, and pamphlet of International Publication No. WO 2005/010398, an impact absorption energy of an impact absorbing member also greatly depends on a shape of the member.

Specifically, by optimizing the shape of the impact absorbing member so as to increase a plastic deformation workload, there is a possibility that the impact absorption energy of the impact absorbing member can be dramatically increased to a level which cannot be achieved only by increasing the strength of the steel material.

However, even when the shape of the impact absorbing member is optimized to increase the plastic deformation workload, if the steel material has no deformability capable of enduring the plastic deformation workload, a crack occurs on the impact absorbing member in an early stage before an expected plastic deformation is completed, resulting in that the plastic deformation workload cannot be increased, and it is not possible to dramatically increase the impact absorption energy. Further, the occurrence of crack on the impact absorbing member in the early stage may lead to an unexpected situation such that another member disposed by being adjacent to the impact absorbing member is damaged.

In the conventional techniques, it has been aimed to increase the dynamic strength of the steel material based on a technical idea that the impact absorption energy of the impact absorbing member depends on the dynamic strength of the steel material, but, there is a case where the deformability is significantly lowered only by aiming the increase in the dynamic strength of the steel material. Accordingly, even if the shape of the impact absorbing member is optimized to increase the plastic deformation workload, it was not always possible to dramatically increase the impact absorption energy of the impact absorbing member.

Further, since the shape of the impact absorbing member has been studied on the assumption that the steel material manufactured based on the above-described technical idea is used, the optimization of the shape of the impact absorbing member has been studied, from the first, based on the deformability of the existing steel material as a premise, and thus the study itself such that the deformability of the steel material is increased and the shape of the impact absorbing member is optimized to increase the plastic deformation workload, has not been done sufficiently so far.

The present invention has a task to provide a steel material suitable for a material of an impact absorbing member having a high effective flow stress and thus having a high impact absorption energy and in which an occurrence of crack when an impact load is applied is suppressed, and a manufacturing method thereof.

Means for Solving the Problems

As described above, in order to increase the impact absorption energy of the impact absorbing member, it is important to optimize not only the steel material but also the shape of the impact absorbing member to increase the plastic deformation workload.

Regarding the steel material, it is important to increase the effective flow stress to increase the plastic deformation workload while suppressing the occurrence of crack when the impact load is applied, so that the shape of the impact absorbing member capable of increasing the plastic deformation workload can be optimized.

The present inventors conducted earnest studies regarding a method of suppressing the occurrence of crack when the impact load is applied and increasing the effective flow stress regarding the steel material to increase the impact absorption energy of the impact absorbing member, and obtained new findings as will be cited hereinbelow.

[Improvement of Impact Absorption Energy]

(1) In order to increase the impact absorption energy of the steel material, it is effective to increase the effective flow stress when a true strain of 5% is given (which will be described as "5% flow stress", hereinafter).

(2) In order to increase the 5% flow stress, it is effective to increase a yield strength and a work hardening coefficient in a low-strain region.

(3) In order to increase the yield strength, it is required to perform refining of steel structure.

(4) In order to increase the work hardening coefficient in the low-strain region, it is effective to efficiently increase a dislocation density in the low-strain region.

(5) In order to efficiently increase the dislocation density in the low-strain region, it is effective to increase a proportion of small-angle grain boundaries (grain boundaries with misorientation angle of less than 15°) in crystal grain boundaries. This is because, although a high-angle grain boundary easily becomes a sink (place of annihilation) of piled-up dislocations, the dislocation is easily accumulated in the small-angle grain boundary, and for this reason, by increasing the proportion of the small-angle grain boundaries, it becomes possible to efficiently increase the dislocation density even in the low-strain region.

[Suppression of Occurrence of Crack when Impact Load is Applied]

(6) When a crack occurs on the impact absorbing member at the time of applying the impact load, the impact absorption energy is lowered. Further, there is also a case where another member adjacent to the impact absorbing member is damaged.

(7) When the strength, particularly the yield strength of the steel material is increased, a sensitivity with respect to a crack at the time of applying the impact load (which is also referred to as "impact crack", hereinafter) (the sensitivity is also referred to as "impact crack sensitivity", hereinafter) becomes high.

(8) In order to suppress the occurrence of impact crack, it is effective to increase a uniform ductility, a local ductility and a fracture toughness.

(9) In order to increase the uniform ductility, it is effective to produce a multi-phase structure made of ferrite as a main phase and a balance formed of a second phase containing one or two or more selected from a group consisting of bainite, martensite and austenite.

(10) In order to increase the local ductility, it is effective to make the second phase to be a soft one, and to provide a plastic deformability equal to a plastic deformability of ferrite being the main phase to the second phase.

(11) In order to increase the fracture toughness, it is effective to refine ferrite being the main phase and the second phase.

The present invention is made based on the above-described new findings, and a gist thereof is as follows.

[1]

A steel material having a chemical composition of, by mass %, C: greater than 0.05% to 0.2%, Mn: 1% to 3%, Si: greater than 0.5% to 1.8%, Al: 0.01% to 0.5%, N: 0.001% to 0.015%, Ti or a sum of V and Ti: greater than 0.1% to 0.25%, Ti: 0.001% or more, Cr: 0% to 0.25%, Mo: 0% to 0.35%, and a balance: Fe and impurities, includes a steel structure being a multi-phase structure having a main phase made of ferrite of 50 area % or more, and a second phase containing one or two or more selected from a group consisting of bainite, martensite and austenite, in which an average nanohardness of the above-described second phase is less than 6.0 GPa, and when a boundary where a misorientation of crystals becomes 2° or more is defined as a grain boundary, and a region surrounded with the grain boundary is defined as a crystal grain, an average grain diameter of all crystal grains in the above-described main phase and the above-described second phase is 3 μm or less, and a proportion of a length of small-angle grain boundaries where the misorientation is 2° to less than 15° in a length of all grain boundaries is 15% or more.

[2]

The steel material according to [1] contains, by mass %, one or two selected from a group consisting of Cr: 0.05% to 0.25%, and Mo: 0.1% to 0.35%.

Effect of the Invention

According to the present invention, it becomes possible to obtain an impact absorbing member capable of suppressing or eliminating an occurrence of crack thereon when an impact load is applied, and having a high effective flow stress, so that it becomes possible to dramatically increase an impact absorption energy of the impact absorbing member. By applying the impact absorbing member as above, it becomes possible to further improve a collision safety of a product of an automobile and the like, which is industrially extremely useful.

MODE FOR CARRYING OUT THE INVENTION

Figure 1:
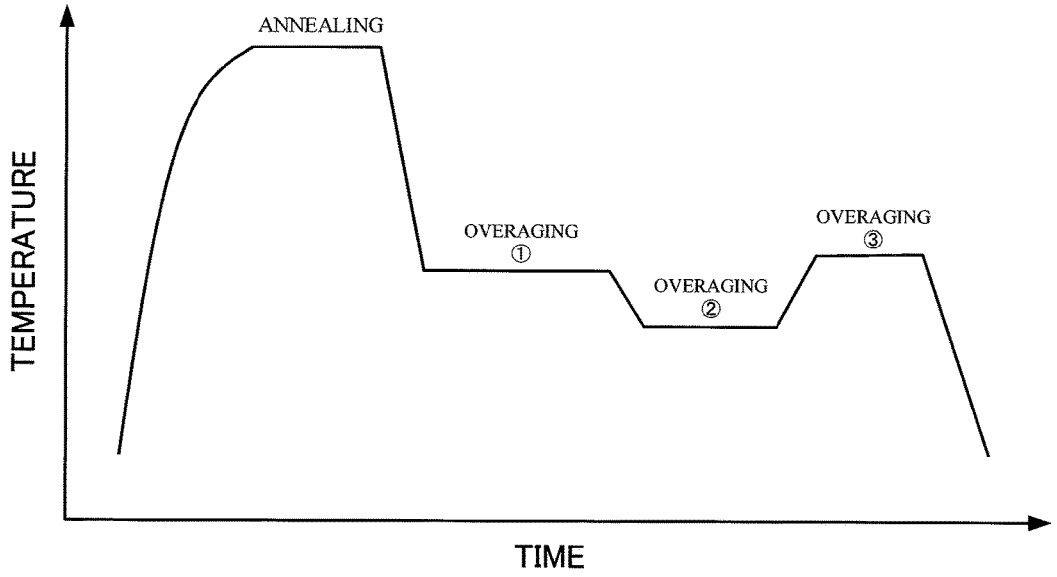
FIG. 1 illustrates a temperature history in continuous annealing heat treatment.

Hereinafter, the present invention will be described in detail.

1. Chemical Composition

Note that "%" in the following description regarding the chemical composition means "mass %", unless otherwise noted.

(1) C: Greater than 0.05% to 0.2%

C has a function of facilitating a generation of bainite, martensite and austenite contained in a second phase, a function of improving a yield strength and a tensile strength by increasing a strength of the second phase, and a function of improving the yield strength and the tensile strength by strengthening a steel through solid-solution strengthening. If a C content is 0.05% or less, it is sometimes difficult to achieve an effect provided by the above-described functions. Therefore, the C content is set to be greater than 0.05%. On the other hand, if the C content exceeds 0.2%, there is a case where martensite and austenite are excessively hardened, resulting in that a local ductility is significantly lowered. Therefore, the C content is set to 0.2% or less. Note that the present invention includes a case where the C content is 0.2%.

(2) Mn: 1% to 3%

Mn has a function of facilitating a generation of the second phase typified by bainite and martensite, a function of improving the yield strength and the tensile strength by strengthening the steel through solid-solution strengthening, and a function of improving the local ductility by increasing a strength of ferrite through solid-solution strengthening and by increasing a hardness of ferrite under a condition where a high strain is applied. If a Mn content is less than 1%, it is sometimes difficult to achieve an effect provided by the above-described functions. Therefore, the Mn content is set to 1% or more. The Mn content is preferably 1.5% or more. On the other hand, if the Mn content exceeds 3%, there is a case where martensite and austenite are excessively generated, resulting in that the local ductility is significantly lowered. Therefore, the Mn content is set to 3% or less. The Mn content is preferably 2.5% or less. Note that the present invention includes a case where the Mn content is 1% and a case where the Mn content is 3%.

(3) Si: Greater than 0.5% to 1.8%

Si has a function of improving a uniform ductility and the local ductility by suppressing a generation of carbide in bainite and martensite, and a function of improving the yield strength and the tensile strength by strengthening the steel through solid-solution strengthening. If a Si content is 0.5% or less, it is sometimes difficult to achieve an effect provided by the above-described functions. Therefore, the Si amount is set to be greater than 0.5%. The Si amount is preferably 0.8% or more, and is more preferably 1% or more. On the other hand, if the Si content exceeds 1.8%, there is a case where austenite excessively remains, and the impact crack sensitivity becomes significantly high. Therefore, the Si content is set to 1.8% or less. The Si content is preferably 1.5% or less, and is more preferably 1.3% or less. Note that the present invention includes a case where the Si content is 1.8%.

(4) Al: 0.01% to 0.5%

Al has a function of suppressing a generation of inclusion in a steel through deoxidation, and preventing the impact crack. However, if an Al content is less than 0.01%, it is difficult to achieve an effect provided by the above-described function. Therefore, the Al content is set to 0.01% or more. On the other hand, if the Al content exceeds 0.5%, an oxide and a nitride become coarse, which facilitates the impact crack, instead of preventing the impact crack. Therefore, the Al content is set to 0.5% or less. Note that the present invention includes a case where the Al content is 0.01% and a case where the Al content is 0.5%.

(5) N: 0.001% to 0.015%

N has a function of suppressing a grain growth of austenite and ferrite by generating a nitride, and suppressing the impact crack by refining a structure. However, if a N content is less than 0.001%, it is difficult to achieve an effect provided by the above-described function. Therefore, the N content is set to 0.001% or more. On the other hand, if the N content exceeds 0.015%, a nitride becomes coarse, which facilitates the impact crack, instead of suppressing the impact crack. Therefore, the N content is set to 0.015% or less. Note that the present invention includes a case where the N content is 0.001% and a case where the N content is 0.015%.

(6) Ti or Sum of V and Ti: Greater than 0.1% to 0.25%

Ti and V have a function of generating carbides such as TiC and VC in the steel, suppressing a growth of coarse crystal grains through a pinning effect with respect to a grain growth of ferrite, and suppressing the impact crack. Further, Ti and V also have a function of improving the yield strength and the tensile strength by strengthening the steel through precipitation strengthening realized by TiC and VC. If a content of Ti or a sum of V and Ti is 0.1% or less, it is difficult to achieve these functions. Therefore, the content of Ti or the sum of V and Ti is set to be greater than 0.1%. The content is preferably 0.15% or more. On the other hand, if the content of Ti or the sum of V and Ti exceeds 0.25%, TiC and VC are excessively generated, which increases the impact crack sensitivity, instead of lowering the impact crack sensitivity. Therefore, the content of Ti or the sum of V and Ti is set to 0.25% or less. The content is preferably 0.23% or less. Note that the present invention includes a case where the content of Ti or the sum of V and Ti is 0.25%.

(7) Ti: 0.001% or More

Further, these functions are exhibited more significantly when 0.001% or more of Ti is contained. Therefore, it is prerequisite that Ti of 0.001% or more is contained. Although the V content may be 0%, it is preferably set to 0.1% or more, and is more preferably set to 0.15% or more. From a point of view of a reduction in the impact crack sensitivity, the V content is preferably set to 0.23% or less. Further, the Ti content is preferably set to 0.01% or less, and is more preferably set to 0.007% or less.

Further, it is also possible that one or two of Cr and Mo is (are) contained as an optionally contained element.

(8) Cr: 0% to 0.25%

Cr is an optionally contained element, and has a function of increasing a hardenability and facilitating a generation of bainite and martensite, and a function of improving the yield strength and the tensile strength by strengthening the steel through solid-solution strengthening. In order to more securely achieve these functions, a content of Cr is preferably 0.05% or more. However, if the Cr content exceeds 0.25%, a martensite phase is excessively generated, which increases the impact crack sensitivity. Therefore, when Cr is contained, the content of Cr is set to 0.25% or less. Note that the present invention includes a case where the content of Cr is 0.25%.

(9) Mo: 0% to 0.35%

Mo is, similar to Cr, an optionally contained element, and has a function of increasing the hardenability and facilitating a generation of bainite and martensite, and a function of improving the yield strength and the tensile strength by strengthening the steel through solid-solution strengthening. In order to more securely achieve these functions, a content of Mo is preferably 0.1% or more. However, if the Mo content exceeds 0.35%, the martensite phase is excessively generated, which increases the impact crack sensitivity. Therefore, when Mo is contained, the content of Mo is set to 0.35% or less. Note that the present invention includes a case where the content of Mo is 0.35%.

The steel material of the present invention contains the above-described essential contained elements, further contains the optionally contained elements according to need, and contains a balance composed of Fe and impurities. As the impurity, one contained in a raw material of ore, scrap and the like, and one contained in a manufacturing step can be exemplified. However, it is allowable that the other components are contained within a range in which the properties of steel material intended to be obtained in the present invention are not inhibited. For example, although P and S are contained in the steel as impurities, P and S are desirably limited in the following manner.

P: 0.02% or Less

P makes a grain boundary to be fragile, and deteriorates a hot workability. Therefore, an upper limit of P content is set to 0.02% or less. It is desirable that the P content is as small as possible, but, based on the assumption that a dephosphorization is performed within a range of actual manufacturing steps and manufacturing cost, the upper limit of P content is 0.02%. The upper limit is desirably 0.015% or less.

S: 0.005% or Less

S makes the grain boundary to be fragile, and deteriorates the hot workability and ductility. Therefore, an upper limit of P content is set to 0.005% or less. It is desirable that the S content is as small as possible, but, based on the assumption that a desulfurization is performed within a range of actual manufacturing steps and manufacturing cost, the upper limit of S content is 0.005%. The upper limit is desirably 0.002% or less.

2. Steel Structure (1) Multi-phase Structure

A steel structure related to the present invention is made to be a multi-phase structure having ferrite with fine crystal grains as a main phase, and a second phase containing one or two or more of bainite, martensite, and austenite with fine crystal grains, in order to realize both of an increase in effective flow stress by obtaining a high yield strength and a high work hardening coefficient in the low-strain region, and an impact crack resistance.

If an area ratio of ferrite being the main phase is less than 50%, the impact crack sensitivity becomes high, and the impact absorption property is lowered. Therefore, the area ratio of ferrite being the main phase is set to 50% or more. An upper limit of the area ratio of ferrite is not particularly defined. If a proportion of the second phase is lowered in accordance with an increase in a proportion of ferrite being the main phase, a strength and a work hardening ratio are lowered. Therefore, the upper limit of the area ratio of ferrite (in other words, a lower limit of area ratio of the second phase) is set in accordance with a strength level.

The second phase contains one or two or more selected from a group consisting of bainite, martensite and austenite. There is a case where cementite and perlite are inevitably contained in the second phase, and such an inevitable structure is allowed to be contained if the structure is 5 area % or less. In order to increase the strength, the area ratio of the second phase is preferably 35% or more, and is more preferably 40% or more.

(2) Average Grain Diameter of Ferrite (Main Phase) and Second Phase: 3 μm or Less In the steel material being an object of the present invention, an average grain diameter of all crystal grains of ferrite and the second phase is set to 3 μm or less. Such a fine structure can be obtained through a device in rolling and heat treatment, and in that case, both of the main phase and the second phase are refined. Further, in such a fine structure, it is difficult to determine an average grain diameter regarding each of ferrite being the main phase and the second phase. Accordingly, in the present invention, the average grain diameter of the entire ferrite being the main phase and second phase, is defined.

If an average grain diameter of ferrite in a steel having ferrite as a main phase is refined, the yield strength is improved, and accordingly, the effective flow stress is increased. If a ferrite grain diameter is coarse, the yield strength becomes insufficient, and the impact absorption energy is lowered.

Further, the refining of the second phase such as bainite, martensite and austenite improves the local ductility, and suppresses the impact crack. If the grain diameter of the second phase is coarse, when an impact load is applied, a brittle fracture easily occurs in the second phase, resulting in that the impact crack sensitivity becomes high.

Therefore, the above-described average grain diameter is set to 3 μm or less. The average grain diameter is preferably 2 μm or less. Although the above-described average grain diameter is preferably finer, there is a limitation in the refining of ferrite grain diameter realized through normal rolling and heat treatment. Further, when the second phase is excessively refined, there is a case where the plastic deformability of the second phase is lowered, which lowers the ductility, instead of increasing the ductility. Therefore, the above-described average grain diameter is preferably set to 0.5 μm or more.

(3) Proportion of Length of Small-Angle Grain Boundaries where Misorientation is 2° to Less than 15° in Length of all Grain Boundaries: 15% or More A grain boundary plays a role of any one of a dislocation generation site, a dislocation annihilation site (sink) and a dislocation pile-up site, and exerts an influence on a work hardening ability of the steel material. Out of the grain boundaries, a high-angle grain boundary where a misorientation is 15° or more easily becomes the annihilation site of piled-up dislocations. On the other hand, in a small-angle grain boundary where the misorientation is 2° to less than 15°, the annihilation of dislocation hardly occurs, which contributes to an increase in dislocation density. Therefore, in order to increase the work hardening coefficient in the low-strain region to increase the effective flow stress, there is a need to increase a proportion of the small-angle grain boundaries described above. If a proportion of a length of the above-described small-angle grain boundaries is less than 15%, it is difficult to increase the work hardening coefficient in the low-strain region to increase the effective flow stress. Therefore, the proportion of the length of the above-described small-angle grain boundaries is set to 15% or more. The proportion is preferably 20% or more, and is more preferably 25% or more. Although it is preferable that the proportion of the small-angle grain boundaries described above is as high as possible, there is a limitation in a proportion of small-angle interface capable of being included in a normal polycrystal. Specifically, it is realistic to set the proportion of the length of the small-angle grain boundaries described above to 70% or less.

The proportion of the small-angle grain boundaries is determined by conducting an EBSD (electron backscatter diffraction) analysis at a position of ¼depth in a sheet thickness of a cross section parallel to a rolling direction of a steel sheet. In an EBSD analysis, several tens of thousands of measurement regions on a surface of a sample are mapped at equal intervals in a grid pattern, and a crystal orientation is determined in each grid. Here, a boundary where a misorientation of crystals between adjacent grids becomes 2° or more is defined as a grain boundary, and a region surrounded with the grain boundary is defined as a crystal grain. If the misorientation becomes less than 2° , a clear grain boundary is not formed. Out of all the grain boundaries, a grain boundary where the misorientation is 2° to less than 15° is defined as a small-angle grain boundary, and a proportion of a length of the small-angle grain boundaries where the misorientation is 2° to less than 15° with respect to a length of total sum of grain boundaries is determined. Note that regarding an average grain diameter of ferrite (main phase) and the second phase, a number of crystal grains defined in a similar manner (regions each surrounded with a grain boundary where the misorientation becomes 2° or more) is counted in a unit area, and based on an average area of the crystal grains, the average grain diameter can be determined as a circle-equivalent diameter.

(4) Average Nanohardness of Second Phase: Less than 6.0 GPa

When the hardness of the second phase such as bainite, martensite and austenite is increased, the local ductility is lowered. Concretely, if an average nanohardness of the second phase exceeds 6.0 GPa, the impact crack sensitivity is increased due to the decrease in the local ductility. Therefore, the average nanohardness of the second phase is set to 6.0 GPa or less.

Here, the nanohardness is a value obtained by measuring a nanohardness in a grain of each phase or structure by using a nanoindentation. In the present invention, a cube corner indenter is used, and a nanohardness obtained under an indentation load of 1000 μN is adopted. The hardness of the second phase is desirably low for improving the local ductility, but, if the second phase is excessively softened, a material strength is lowered. Therefore, the average nanohardness of the second phase is preferably greater than 3.5 GPa, and is more preferably greater than 4.0 GPa.

3. Manufacturing Method

In order to obtain the steel material of the present invention, it is preferable that VC and TiC are properly precipitated in a hot-rolling step and a temperature-raising process in a heat treatment step, a growth of coarse crystal grains is suppressed by the pinning effect provided by VC and TiC, and an optimization of multi-phase structure is realized by subsequent heat treatment. In order to achieve this, it is preferable to perform manufacture through the following manufacturing method.

(1) Hot-rolling Step and Cooling Step

A slab having the above-described chemical composition set to have a temperature of 1200° C. or more, is subjected to multi-pass rolling at a total reduction ratio of 50% or more, and hot rolling is completed in a temperature region of not less than 800° C. nor more than 950° C. After the completion of the hot rolling, the resultant is rolled at a cooling rate of 600° C./second or more, and after the completion of the rolling, the resultant is cooled to a temperature region of 700° C. or less within 0.4 seconds (this cooling is also referred to as primary cooling), and then retained for 0.4 seconds or more in a temperature region of not less than 600° C. nor more than 700° C. After that, the resultant is cooled to a temperature region of 500° C. or less at a cooling rate of less than 100° C./second (this cooling is also referred to as secondary cooling), and then further cooled to a room temperature at a cooling rate of 0.03° C./second or less, thereby obtaining a hot-rolled steel sheet. The last cooling at the cooling rate of 0.03° C./second or less is cooling performed on the steel sheet which is coiled in a coil state, so that in a case where the steel sheet is a steel strip, by coiling the steel strip after the secondary cooling, the last cooling at the cooling rate of 0.03° C./second or less is realized.

Here, in the above-described primary cooling, after the hot rolling is practically completed, rapid cooling is conducted to a temperature region of 700° C. or less within 0.4 seconds. The practical completion of hot rolling means a pass in which the practical rolling is conducted at last, in the rolling of plurality of passes conducted in finish rolling of the hot rolling. For example, in a case where the practical final reduction is conducted in a pass on an upstream side of a finishing mill, and the practical rolling is not conducted in a pass on a downstream side of the finishing mill, the rapid cooling (primary cooling) is conducted to the temperature region of 700° C. or less within 0.4 seconds after the rolling in the pass on the upstream side is completed. Further, for example, in a case where the practical rolling is conducted up to when the pass reaches the pass on the downstream side of the finishing mill, the rapid cooling (primary cooling) is conducted to the temperature region of 700° C. or less within 0.4 seconds after the rolling in the pass on the downstream side is completed. Note that the primary cooling is basically conducted by a cooling nozzle disposed on a run-out-table, but, it is also possible to be conducted by an inter-stand cooling nozzle disposed between the respective passes of the finishing mill.

The cooling rate (600° C/second or more) in the above-described primary cooling and the cooling rate (less than 100° C/second) in the above-described secondary cooling are both set based on a temperature of a surface of a sample (surface temperature of steel sheet) measured by a thermotracer. A cooling rate (average cooling rate) of the entire steel sheet in the above-described primary cooling is estimated to be about 200° C/second or more, as a result of conversion from the cooling rate (600° C/second or more) based on the surface temperature.

By the above-described hot-rolling step and cooling step, the hot-rolled steel sheet in which the carbide of V (VC) and the carbide of Ti (TiC) are precipitated at high density in the ferrite grain boundary, is obtained. It is preferable that an average grain diameter of VC and TiC is 10 nm or more, and an average intergranular distance of VC and TiC is 2 μm or less.

(2) Cold-rolling Step

The hot-rolled steel sheet obtained by the above-described hot-rolling step and cooling step may be directly subjected to a later-described heat treatment step, but, it may also be subjected to the later-described heat treatment step after being subjected to cold rolling.

When the cold rolling is performed on the hot-rolled steel sheet obtained by the above-described hot-rolling step and cooling step, the cold rolling at a reduction ratio of not less than 30% nor more than 70% is performed, to thereby obtain a cold-rolled steel sheet.

(3) Heat Treatment Step (Steps (C1) and (C2))

A temperature of the hot-rolled steel sheet obtained by the above-described hot-rolling step and cooling step or the cold-rolled steel sheet obtained by the above-described cold-rolling step is raised to a temperature region of not less than 750° C. nor more than 920° C. at an average temperature rising rate of not less than 2° C./second nor more than 20° C./second, and the steel sheet is retained in the temperature region for a period of time of not less than 20 seconds nor more than 100 seconds (annealing in FIG. 1). Subsequently, heat treatment in which the resultant is cooled to a temperature region of not less than 440° C. nor more than 550° C. at an average cooling rate of not less than 5° C./second nor more than 20° C./second, and retained in the temperature region for a period of time of not less than 30 seconds nor more than 150 seconds, is performed (overaging 1 to overaging 3 in FIG. 1).

If the above-described average temperature rising rate is less than 2° C./second, the grain growth of ferrite occurs during the temperature rising, resulting in that the crystal grains become coarse. On the other hand, if the above-described average temperature rising rate is greater than 20° C./second, the precipitation of VC and TiC during the temperature rising becomes insufficient, resulting in that the crystal grain diameter becomes coarse, instead of becoming fine.

If the temperature retained after the above-described temperature rising is less than 750° C. or greater than 920° C., it is difficult to obtain an intended multi-phase structure.

If the above-described average cooling rate is less than 5° C./second, a ferrite amount becomes excessive, and it is difficult to obtain a sufficient strength. On the other hand, if the above-described average cooling rate is greater than 20° C./second, a hard second phase is excessively generated, resulting in that the impact crack sensitivity is increased.

The retention after the above-described cooling is important to facilitate softening of the second phase to secure the average nanohardness of the second phase of less than 6.0 GPa. In a case where the condition such that the retention is performed in the temperature region of not less than 440° C. nor more than 550° C. for a period of time of not less than 30 seconds nor more than 150 seconds, is not satisfied, it is difficult to obtain a desired property of the second phase. There is no need to set the temperature to be a fixed temperature during the retention, and the temperature can be changed continuously or in stages as long as it is within the temperature region of not less than 440° C. nor more than 550'C (refer to overaging 1 to overaging 3 illustrated in FIG. 1, for example). From a point of view of controlling the small-angle grain boundary and the precipitates of V and Ti, the temperature is preferably changed in stages. Specifically, the above-described treatment is treatment corresponding to so-called overaging treatment in continuous annealing, in which in an initial stage of the overaging treatment step, it is preferable to increase the proportion of small-angle grain boundaries by performing retention in an upper bainite temperature region. Concretely, it is preferable to perform the retention in a temperature region of not less than 480° C. nor more than 580° C. After that, in order to make Ti and V remained in the ferrite phase and the second phase in a supersaturated manner to be precipitated, the retention is performed in a temperature region of not less than 440° C. not more than 480° C. to generate a precipitation nucleus, and then the retention is performed in a temperature region of not less than 480° C. nor more than 550° C. to increase a precipitation amount. A fine carbide such as VC precipitated in the ferrite phase and the second phase improves the effective flow stress, so that it is desirable to cause the precipitation at high density through the above-described overaging treatment.

The hot-rolled steel sheet or the cold-rolled steel sheet manufactured as above may be used as it is as the steel material of the present invention, or a steel sheet, cut from the hot-rolled steel sheet or the cold-rolled steel sheet, on which appropriate working such as bending and presswork is performed according to need, may also be employed as the steel material of the present invention. Further, the steel material of the present invention may also be the steel sheet as it is, or the steel sheet on which plating is performed after the working. The plating may be either electroplating or hot dipping, and although there is no limitation in a type of plating, the type of plating is normally zinc or zinc alloy plating.

EXAMPLES

An experiment was conducted by using slabs (each having a thickness of 35 mm, a width of 160 to 250 mm, and a length of 70 to 90 mm) having chemical compositions presented in Table 1. In Table 1, "-" means that the element is not contained positively. An underline indicates that a value is out of the range of the present invention. A steel type E is a comparative example in which a total content of V and Ti is less than the lower limit value. A steel type F is a comparative example in which a content of Ti is less than the lower limit value. A steel type H is a comparative example in which a content of Mn is less than the lower limit value. In each of the steel types, a molten steel of 150 kg was produced in vacuum to be cast, the resultant was then heated at a furnace temperature of 1250° C., and subjected to hot forging at a temperature of 950° C. or more, to thereby obtain a slab.

TABLE 1

| STEEL | CHEMICAL COMPOSITION (UNIT: MASS %, BALANCE: Fe AND IMPURITIES) | | | | | | | | | | |
|---|---|---|---|---|---|---|---|---|---|---|---|
| TYPE | C | Si | Mn | P | S | Cr | Mo | V | Ti | Al | N |
| A | 0.12 | 1.24 | 2.05 | 0.008 | 0.002 | 0.12 | — | 0.20 | 0.005 | 0.033 | 0.0024 |
| B | 0.15 | 1.25 | 2.01 | 0.010 | 0.002 | 0.15 | — | 0.20 | 0.005 | 0.035 | 0.0035 |
| C | 0.12 | 1.20 | 2.20 | 0.011 | 0.002 | 0.15 | — | 0.20 | 0.006 | 0.035 | 0.0031 |
| D | 0.12 | 1.23 | 2.01 | 0.009 | 0.002 | 0.20 | 0.20 | 0.15 | 0.005 | 0.030 | 0.0025 |
| E | 0.12 | 1.25 | 2.01 | 0.009 | 0.002 | 0.15 | — | 0.05 | 0.005 | 0.032 | 0.0026 |
| F | 0.12 | 1.23 | 2.25 | 0.011 | 0.002 | 0.15 | — | 0.20 | — | 0.035 | 0.0045 |
| G | 0.07 | 0.55 | 1.98 | 0.010 | 0.002 | — | — | — | 0.12 | 0.035 | 0.0032 |
| H | 0.15 | 1.55 | 0.5 | 0.009 | 0.001 | 0.15 | — | 0.20 | 0.005 | 0.033 | 0.0025 |
| I | 0.15 | 1.52 | 3.5 | 0.012 | 0.002 | 0.15 | — | 0.20 | 0.004 | 0.035 | 0.0035 |
| J | 0.15 | 0.72 | 2.02 | 0.010 | 0.001 | 0.15 | — | 0.20 | 0.005 | 0.35 | 0.0025 |

Each of the above-described slabs was reheated at 1250° C. within 1 hour, and after that, the resultant was subjected to rough hot rolling in 4 passes by using a hot-rolling testing machine, the resultant was further subjected to finish hot rolling in 3 passes, and after the completion of rolling, primary cooling and cooling in two stages were conducted, to thereby obtain a hot-rolled steel sheet. Hot-rolling conditions are presented in Table 2. The primary cooling and the secondary cooling right after the completion of rolling were conducted by water cooling. By completing the secondary cooling at a coiling temperature presented in Table, and letting a coil cool, the cooling to a room temperature at a cooling rate of 0.03° C./second or less was realized. A sheet thickness of each of the hot-rolled steel sheets was set to 2 mm.

TABLE 2

| | | HOT ROLLING | | | | |
|---|---|---|---|---|---|---|
| | | ROUGH ROLLING | FINISH HOT ROLLING | | | PRIMARY COOLING |
| TEST NUMBER | STEEL TYPE | TOTAL REDUCTION RATIO (%) | NUMBER OF PASSES | REDUCTION RATIO IN EACH PASS | FINISH ROLLING TEMPERATURE (° C.) | AVERAGE COOLING RATE (° C./s) |
| 1 | A | 83 | 3 | 30%-30%-30% | 900 | >1000 |
| 2 | | | | | | |
| 3 | | | | | | |
| 4 | | | | | | |
| 5 | | | | | | |
| 6 | | | | | | |
| 7 | | | | | | |
| 8 | B | 83 | 3 | 30%-30%-30% | 850 | >1000 |
| 9 | C | 83 | 3 | 30%-30%-30% | 850 | >1000 |
| 10 | D | 83 | 3 | 30%-30%-30% | 850 | >1000 |
| 11 | E | 83 | 3 | 30%-30%-30% | 850 | >1000 |
| 12 | F | 83 | 3 | 30%-30%-30% | 850 | >1000 |
| 13 | G | 83 | 3 | 33%-33%-33% | 850 | >1000 |
| 14 | H | 83 | 3 | 30%-30%-30% | 900 | >1000 |
| 15 | I | 83 | 3 | 30%-30%-30% | 900 | >1000 |
| 16 | J | 83 | 3 | 30%-30%-30% | 900 | >1000 |

| | PRIMARY COOLING | | SECONDARY COOLING | | SHEET THICKNESS |
|---|---|---|---|---|---|
| TEST NUMBER | COOLING STOP TEMPERATURE (° C.) | PERIOD OF TIME FROM COMPLETION OF ROLLING TO START OF COOLING (s) | AVERAGE COOLING RATE (° C./s) | COILING TEMPERATURE (° C.) | OF HOT-ROLLED STEEL SHEET (mm) |
| 1 | 650 | 0.1 | 70 | 400 | 2 |
| 2 | | | | | |
| 3 | | | | | |
| 4 | | | | | |
| 5 | | | | | |
| 6 | | 1.2 | | | |
| 7 | 450 | 0.1 | | | |
| 8 | 650 | 0.1 | 70 | 400 | 2 |
| 9 | 650 | 0.1 | 70 | 400 | 2 |
| 10 | 650 | 0.1 | 70 | 400 | 2 |
| 11 | 650 | 0.1 | 70 | 400 | 2 |
| 12 | 650 | 0.1 | 70 | 400 | 2 |

TABLE 2-continued

| | | | | | |
|---|---|---|---|---|---|
| 13 | 650 | 0.1 | 70 | 450 | 2 |
| 14 | 650 | 0.1 | 70 | 400 | 2 |
| 15 | 650 | 0.1 | 70 | 400 | 2 |
| 16 | 650 | 0.1 | 70 | 400 | 2 |

A part of the hot-rolled steel sheets was subjected to cold rolling, and then all of the steel sheets were subjected to heat treatment by using a continuous annealing simulator with a heat pattern presented in FIG. 1 and under conditions presented in Table 3. In the present examples, the reason why the temperature retention (referred to as overaging in the examples) after cooling was performed from the annealing temperature was conducted at three stages of different temperatures as presented in FIG. 1 and Table 3, is because the proportion of small-angle grain boundaries and the precipitation density of VC carbide are made to be increased.

boundary where a misorientation of crystals became 2° or more was defined as a grain boundary, an average grain diameter was determined without distinguishing between a main phase and a second phase, and a grain boundary surface misorientation map was created. Out of all grain boundaries, a grain boundary where the misorientation was 2° to less than 15° was defined as a small-angle grain boundary, and a proportion of a length of small-angle grain boundaries where the misorientation was 2° to less than 15° with respect to a length of total sum of grain boundaries was determined. Further, an area ratio of ferrite was determined from an image quality map obtained by this analysis.

TABLE 3

| | | CONDITIONS OF CONTINUOUS ANNEALING | | | | | | | | | |
|---|---|---|---|---|---|---|---|---|---|---|---|
| | | | | | | CONDITIONS OF OVERAGING (①→②→③) | | | | | |
| | TOTAL | CONDITIONS OF ANNEALING | | | | OVER- | | OVER- | | OVER- | |
| TEST NUMBER | REDUCTION RATIO IN COLD ROLLING | TEMPERATURE RISING RATE (° C./s) | ANNEALING TEMPERATURE (° C.) | ANNEALING TIME (s) | COOLING RATE (° C./s) | AGING TEMPERATURE ① (° C.) | OVERAGING TIME ① (s) | AGING TEMPERATURE ② (° C.) | OVERAGING TIME ② (s) | AGING TEMPERATURE ③ (° C.) | OVERAGING TIME ③ (s) |
| 1 | NONE | 10 | 770 | 30 | 10 | 500 | 40 | 460 | 22 | 520 | 15 |
| 2 | 50% | 10 | 770 | 30 | 10 | 500 | 40 | 460 | 22 | 520 | 15 |
| 3 | 50% | 10 | 850 | 30 | 10 | 500 | 40 | 460 | 22 | 520 | 15 |
| 4 | 50% | 10 | 770 | 30 | 40 | 400 | 40 | 460 | 22 | 520 | 15 |
| 5 | 50% | 10 | 850 | 30 | 40 | 400 | 40 | 460 | 22 | 520 | 15 |
| 6 | 50% | 10 | 770 | 30 | 10 | 500 | 40 | 460 | 22 | 520 | 15 |
| 7 | 50% | 10 | 770 | 30 | 10 | 500 | 40 | 460 | 22 | 520 | 15 |
| 8 | 50% | 10 | 800 | 30 | 10 | 500 | 40 | 460 | 22 | 520 | 15 |
| 9 | 50% | 10 | 800 | 30 | 10 | 500 | 40 | 460 | 22 | 520 | 15 |
| 10 | 50% | 10 | 800 | 30 | 10 | 500 | 40 | 460 | 22 | 520 | 15 |
| 11 | 50% | 10 | 800 | 30 | 10 | 500 | 40 | 460 | 22 | 520 | 15 |
| 12 | 50% | 10 | 800 | 30 | 10 | 500 | 40 | 460 | 22 | 520 | 15 |
| 13 | 50% | 10 | 850 | 30 | 10 | 460 | 40 | 460 | 22 | 500 | 15 |
| 14 | 50% | 10 | 850 | 30 | 10 | 460 | 40 | 460 | 22 | 500 | 15 |
| 15 | 50% | 10 | 850 | 30 | 10 | 460 | 40 | 460 | 22 | 500 | 15 |
| 16 | 50% | 10 | 870 | 30 | 10 | 460 | 40 | 460 | 22 | 500 | 15 |

Regarding the hot-rolled steel sheets and the cold-rolled steel sheets obtained as above, the following examination was conducted.

First, a JIS No. 5 tensile test piece was collected from a test steel sheet in a direction perpendicular to a rolling direction, and subjected to a tensile test, thereby determining a 5% flow stress, a maximum tensile strength (TS), and a uniform elongation (u-El). The 5% flow stress indicates a stress when a plastic deformation occurs in which a strain becomes 5% in the tensile test, the 5% flow stress has a proportionality relation with the effective flow stress, and becomes an index of the effective flow stress.

A hole expansion test was conducted to determine a hole expansion ratio based on Japan Iron and Steel Federation standard JFST 1001-1996 except that reamer working was performed on a machined hole to remove an influence of a damage of end face.

The EBSD analysis was conducted at a position of ¼ depth in a sheet thickness of a cross section parallel to a rolling direction of the steel sheet. In the EBSD analysis, a A nanohardness of the second phase was determined by a nanoindentation method. A section test piece collected in a direction parallel to the rolling direction at a position of ¼ depth in a sheet thickness was polished by an emery paper, the resultant was subjected to mechanochemical polishing using colloidal silica, and then further subjected to electrolytic polishing to remove a worked layer, and then the resultant was subjected to a test. The nanoindentation was carried out by using a cube corner indenter under an indentation load of 1000 μN. An indentation size at this time is a diameter of 0.5 μm or less. The hardness of the second phase of each sample was measured at randomly-selected 20 points, and an average nanohardness of each sample was determined.

Further, an square tube member was produced by using each of the above-described steel sheets, and an axial crush test was conducted at a collision speed in an axial direction of 64 km/h, to thereby evaluate a collision absorbency. A shape of a cross section perpendicular to the axial direction of the square tube member was set to an equilateral octagon, and a length in the axial direction of the square tube member was set to 200 mm. The evaluation was conducted under a condition where each member was set to have a sheet thickness of 1 mm, and a length of one side of the above-described equilateral octagon (length of straight portion except for curved portion of corner portion) (Wp) of 16 mm. Two of such square tube members were produced from each of the steel sheets, and subjected to the axial crush test. The evaluation was conducted based on an average load when the axial crush occurred (average value of two times of test) and a stable bucking ratio. The stable buckling ratio corresponds to a proportion of a number of test bodies in which no crack occurred in the axial crush test, with respect to a number of all test bodies. Generally, the possibility in which the crack occurs in the middle of the crush is increased when an impact absorption energy is increased, resulting in that a plastic deformation workload cannot be increased, and there is a case where the impact absorption energy cannot be increased. Specifically, no matter how high the average crush load (impact absorbency) is, it is not possible to exhibit a high impact absorbency unless the stable buckling ratio is good.

Results of the examination described above (steel structure, mechanical properties, and axial crush properties) are collectively presented in Table 4.

Figure 2:
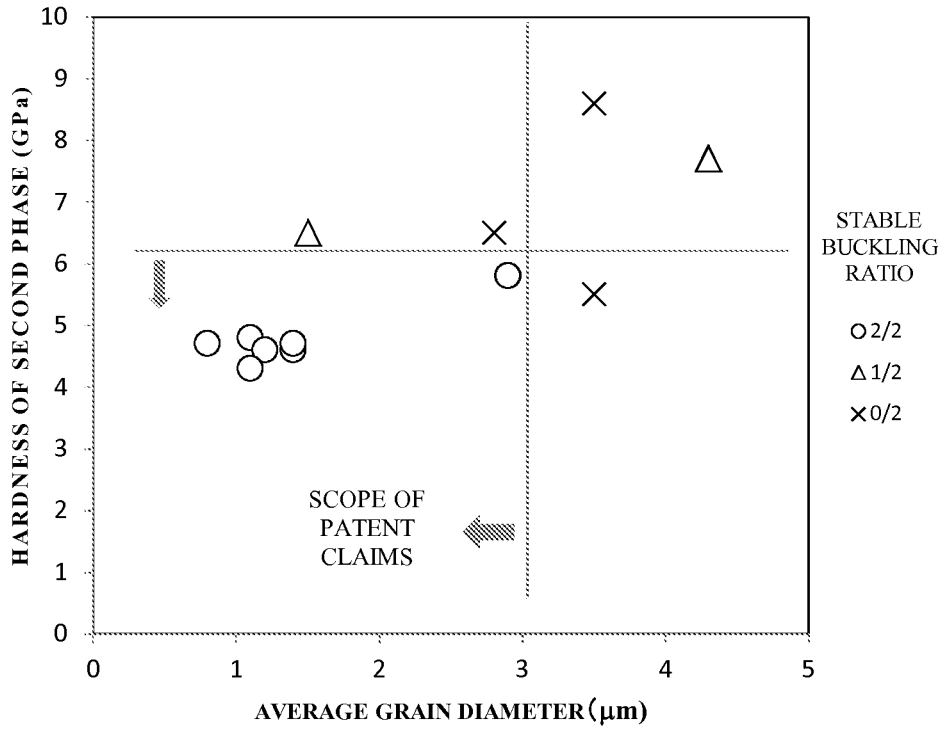
FIG. 2 is a graph illustrating a relationship of a hardness of a second phase and a stable buckling ratio obtained by an axial crush test with respect to an average grain diameter, in which ○ indicates that a stable buckling occurs with no occurrence of crack, Δ indicates that a crack occurs with a probability of ½, and X indicates that a crack occurs with a probability of 2/2, and an unstable buckling occurs.
Figure 3:
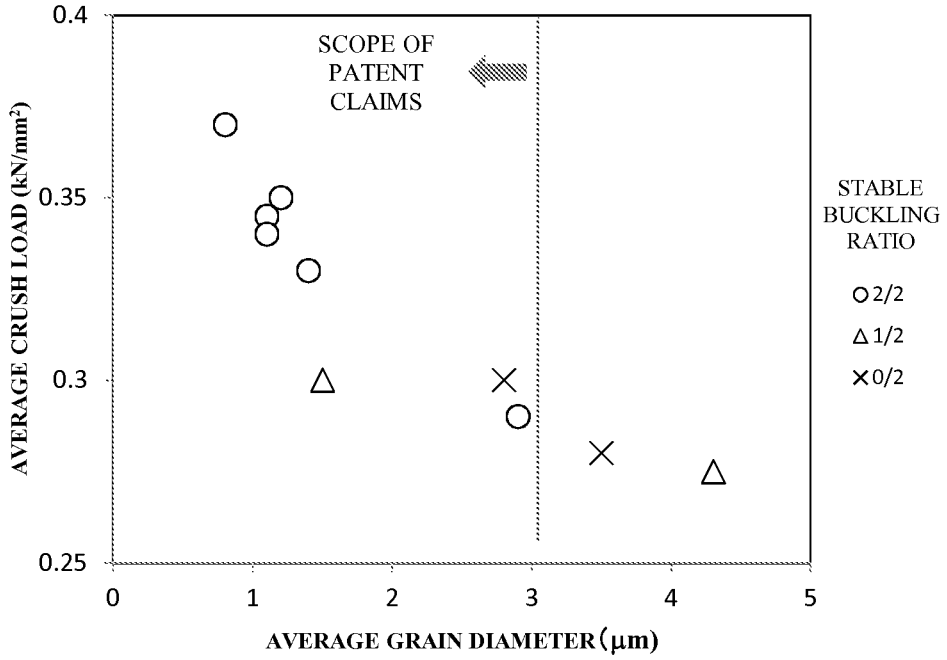
FIG. 3 is a graph illustrating a relationship between an average grain diameter and an average crush load obtained by the axial crush test.

Further, a relationship of the hardness of the second phase and the stable buckling ratio with respect to an average grain diameter of each of test numbers 1 to 16, is illustrated by graph in FIG. 2. FIG. 3 is a graph illustrating a relationship between the grain diameter and the average crush load.

TABLE 4

| | STRUCTURE | | | | | |
|---|---|---|---|---|---|---|
| TEST NUMBER | STRUCTURE | PROPORTION OF FERRITE PHASE (%) | AVERAGE GRAIN DIAMETER (μm) | PROPORTION OF SMALL-ANGLE INTERFACE (%) | AVERAGE HARDNESS OF SECOND PHASE (GPa) | TENSILE AND HOLE EXPANSION PROPERTIES 5% FLOW STRESS (MPa) |
| 1 | α + B + γ | 68 | 0.8 | 25 | 4.7 | 1055 |
| 2 | α + B + γ | 60 | 1.1 | 31 | 4.8 | 1022 |
| 3 | α + B + γ | 62 | 1.4 | 28 | 4.6 | 975 |
| 4 | α + B + M | 60 | 1.5 | 24 | 6.5 | 977 |
| 5 | B + M | <10 | — | 55 | 8.7 | 950 |
| 6 | α + B + γ | 55 | 3.5 | 8 | 5.5 | 788 |
| 7 | α + B + γ | 45 | 2.8 | 26 | 6.5 | 801 |
| 8 | α + B + γ | 60 | 1.2 | 28 | 4.6 | 1034 |
| 9 | α + B + γ | 65 | 1.1 | 32 | 4.3 | 1016 |
| 10 | α + B + γ | 63 | 1.4 | 29 | 4.7 | 976 |
| 11 | α + B + γ | 55 | 4.3 | 12 | 7.7 | 713 |
| 12 | α + B + γ | 57 | 3.5 | 14 | 8.6 | 805 |
| 13 | α + B | 70 | 2.9 | 27 | 5.8 | 855 |
| 14 | α | >90 | 4.3 | 15 | — | 532 |
| 15 | M + α + B | <10 | — | 45 | 9.5 | 1223 |
| 16 | α + B + γ | 65 | 1.3 | 30 | 4.6 | 978 |

| | TENSILE AND HOLE EXPANSION PROPERTIES | | | AXIAL CRUSH PROPERTY | |
|---|---|---|---|---|---|
| TEST NUMBER | MAXIMUM TENSILE STRESS (MPa) | UNIFORM ELONGATION (%) | HOLE EXPANDABILITY (%) | AVERAGE CRUSH LOAD (kN/mm2) | STABLE BUCKLING RATIO |
| 1 | 1067 | 10.5 | 115 | 0.37 | 2/2 |
| 2 | 1055 | 10.9 | 108 | 0.345 | 2/2 |
| 3 | 1038 | 11.1 | 112 | 0.33 | 2/2 |
| 4 | 1028 | 12.3 | 84 | 0.3 | 1/2 |
| 5 | 1015 | 9.9 | 75 | 0.32 | 0/2 |
| 6 | 1035 | 12.5 | 65 | 0.28 | 0/2 |
| 7 | 1028 | 10.7 | 68 | 0.3 | 0/2 |
| 8 | 1052 | 10.5 | 120 | 0.35 | 2/2 |
| 9 | 1048 | 10.7 | 105 | 0.34 | 2/2 |
| 10 | 1034 | 11.0 | 105 | 0.33 | 2/2 |
| 11 | 998 | 12.5 | 78 | 0.275 | 1/2 |
| 12 | 1003 | 9.8 | 84 | 0.28 | 0/2 |
| 13 | 980 | 9.8 | 116 | 0.29 | 2/2 |
| 14 | 623 | 20.5 | 135 | 0.18 | 2/2 |
| 15 | 1225 | 1.5 | 25 | 0.22 | 0/2 |
| 16 | 1055 | 10.9 | 111 | 0.33 | 2/2 |

As can be understood from Table 4, FIG. 2 and FIG. 3, in the steel material related to the present invention, the average load when the axial crush occurs is high to be 0.29 $kJ/mm^2$ or more. Further, a good axial crush property is exhibited such that the stable buckling ratio is 2/2. Therefore, the steel material related to the present invention is suitably used as a material of the above-described crush box, a side member, a center pillar, a rocker and the like.

The invention claimed is:

1. A steel material having a chemical composition of, by mass %,

C: greater than 0.05% to 0.2%,

Mn: 1% to 3%,

Si: greater than 0.72% to 1.8%,
Al: 0.01% to 0.5%,
N: 0.001% to 0.015%,
Ti: greater than 0.1% to 0.25%,
Cr: 0% to 0.25%,
Mo: 0% to 0.35%, and
a balance: Fe and impurities, the steel material comprising
a steel structure being a multi-phase structure having a main phase made of ferrite of 50 area % or more, and a second phase containing one or two or more selected from a group consisting of bainite, martensite and austenite, wherein:
an average nanohardness of the second phase is less than 6.0 GPa;
a boundary where a misorientation of crystals becomes 2° or more is defined as a grain boundary, a region surrounded with the grain boundary is defined as a crystal grain, an average grain diameter of all crystal grains in the main phase and the second phase is 3 μm or less, and a proportion of a length of small-angle grain boundaries where the misorientation is 2° to less than 15° in a length of all grain boundaries is 15% or more;
an average grain diameter of TiC is 10 nm or more; and
an average intergranular distance of TiC is 2 μm or less.

2. The steel material according to claim 1, wherein
one or two selected from a group consisting of Cr: 0.05% to 0.25%, and Mo: 0.1% to 0.35% is/are contained, by mass%.

3. A steel material having a chemical composition of, by mass%,
C: greater than 0.05% to 0.2%,
Mn: 1% to 3%,
Si: greater than 0.5% to 1.8%,
Al: 0.01% to 0.5%,
N: 0.001% to 0.015%,
a sum of V and Ti: greater than 0.1% to 0.25%,
Ti: 0.001% or more,
V: 0.1% or more,
Cr: 0% to 0.25%,
Mo: 0% to 0.35%, and
a balance: Fe and impurities, the steel material comprising
a steel structure being a multi-phase structure having a main phase made of ferrite of 50area% or more, and a second phase containing one or two or more selected from a group consisting of bainite, martensite and austenite, wherein:
an average nanohardness of the second phase is less than 6.0 GPa; and
when a boundary where a misorientation of crystals becomes 2° or more is defined as a grain boundary, and a region surrounded with the grain boundary is defined as a crystal grain, an average grain diameter of all crystal grains in the main phase and the second phase is 3 μm or less, and a proportion of a length of small-angle grain boundaries where the misorientation is 2° to less than 15° in a length of all grain boundaries is 15% or more;
an average grain diameter of VC and TiC is 10 nm or more; and
an average intergranular distance of VC and TiC is 2 μm or less.

* * * * *